United States Patent [19]

Shiomi

[11] 4,417,536

[45] Nov. 29, 1983

[54] LATERALLY PIVOTABLE UPPER FEED DOG

[75] Inventor: Kengo Shiomi, Tokyo, Japan

[73] Assignee: Tokyo Juki Industrial Co., Ltd., Tokyo, Japan

[21] Appl. No.: 333,317

[22] Filed: Dec. 22, 1981

[30] Foreign Application Priority Data

Dec. 25, 1980 [JP] Japan ..... 55-184830

[51] Int. Cl.[3] ..... D05B 27/06

[52] U.S. Cl. ..... 112/311; 112/320

[58] Field of Search ..... 112/311, 320, 323

[56] References Cited

U.S. PATENT DOCUMENTS

| | | | |
|---|---|---|---|
| 3,262,410 | 7/1966 | Chernes | 112/311 |
| 3,530,809 | 9/1970 | Porter | 112/311 |
| 4,285,294 | 8/1981 | Aida | 112/311 |

*Primary Examiner*—Werner H. Schroeder
*Assistant Examiner*—Andrew M. Falik
*Attorney, Agent, or Firm*—Koda & Androlia

[57] ABSTRACT

The upper feed dog for the cloth feed mechanism of a sewing machine can be moved sideways from a position opposing the sewing area to be separated from the sewing area to thus facilitate needle exchange and threading. The cloth feed mechanism of the sewing machine includes lower feed dogs which move towards and away from as well as longitudinally to a throat plate and a support member. The support member has an upper feed dog secured thereon which moves, interlocked with a driving member, in four directions above the upper surface of the throat plate with a phase in the vertical movement opposite that of the vertical movement of the lower feed dog and with a phase in the longitudinal movement identical to that of the longitudinal movement of the lower feed dog for feeding the cloth in synchronism with the lower feed dog. The support member is supported rotatably about a vertical shaft so as to oppose or separate the feed dog to or from the sewing area.

4 Claims, 8 Drawing Figures

LATERALLY PIVOTABLE UPPER FEED DOG

BACKGROUND OF THE INVENTION

1. Field of the Invention

This invention concerns a cloth feed mechanism for sewing machines and, more specifically, it relates to an upper feed dog mechanism that moves in four directions on or above the upper surface of a cloth interlocked with the mechanism of the sewing machine for feeding the cloth.

2. Description of the Prior Art

The conventional upper feed dog mechanism of this type is designed to move in four directions in cooperation with a lower feed dog mechanism having a main feed dog and a sub feed dog in such a way that is descends when the main and sub feed dogs rise and vice versa, that is, with an opposite phase in its vertical movement to that in the vertical movement of the main and sub feed dogs. Further, the main and sub feed dogs and the upper feed dog are operationally related to the vertical movement of a needle such that when each of the feed dogs separates from the cloth downwardly or upwardly to complete the cloth feeding, the needle is inserted into the cloth; and when the needle leaves the cloth, each of the feed dogs move upwardly or downwardly to feed the cloth in contact therewith. Furthermore, as disclosed in Japanese Patent Application No. 92329/1979 and in Japanese Patent Laid-Open Publication No. 25149/1978, the upper feed dog is fixedly supported to a top end of an upper feed arm that moves in four directions interlocked with the mechanism of the sewing machine.

Such a mechanical arrangement, however, has several drawbacks. For instance, since the upper feed dog presses the upper surface of the cloth when the needle disengages from the cloth and the needle is inserted into the cloth when the upper feed dog rises from the cloth, it is impossible to remove the cloth during the sewing work from the sewing area. Further, since the upper feed dog is always situated near the sewing area and cannot be moved to another position separated therefrom, the upper feed dog interferes with such work as exchanging the needle, threading the needle or removing thread entangled in the sewing area or the looper due to thread disconnection and the working efficiency is reduced.

SUMMARY OF THE INVENTION

This invention has been made in view of the foregoing defects the conventional cloth feed mechanism for sewing machines and it is an object of this invention to provide a cloth feed mechanism for sewing machines, which enables an operator to remove the cloth from the sewing area during sewing work and which facilitates work such as for exchanging the needle, threading the needle and removing thread entangled in the sewing area or the looper due to thread disconnection of the like.

The above object can be attained according to this invention wherein a support member, having fixed thereon an upper feed dog that moves in four directions above the upper surface of a throat plate interlocked with a driving member, is supported rotatably around a vertical shaft so as to separate the upper feed dog from the position opposing the sewing area.

BRIEF DESCRIPTION OF THE DRAWING

These and other objects, as well as the advantages of this invention will be made more clear by the following explanations referring to preferred embodiments shown in the accompanying drawings, wherein FIGS. 3, 4 and 5 show a third embodiment of this invention, in which FIG. 3 is a schematic perspective view for the cloth presser part in an overlock type sewing machine, FIG. 4 is a side elevational view of the presser arm and FIG. 5 is a cross sectional view taken along line V—V in FIG. 4.

DETAILED DESCRIPTION OF THE INVENTION

Figure 1:
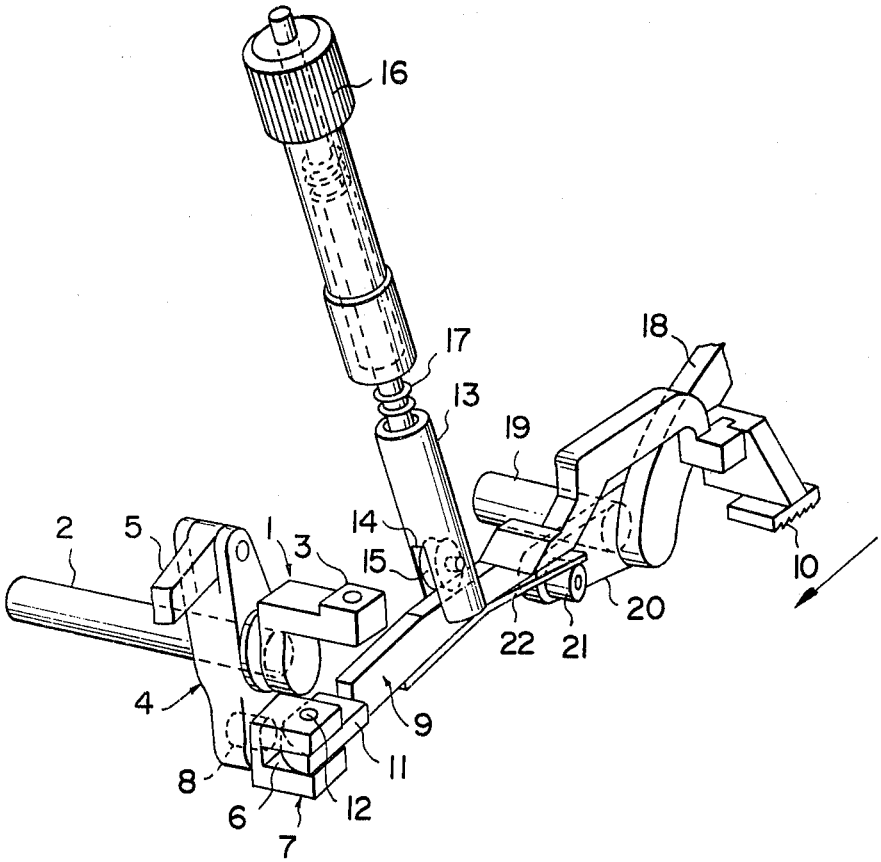
FIG. 1 is a perspective view for a part of the upper feed dog mechanism in a first embodiment of this invention.

This invention is to be explained by way of its several preferred embodiments referring to the drawings.

FIG. 1 shows a first embodiment, wherein a presser arm support member 1 is rotatably supported at one end by its shaft 2 to a machine frame and integrally formed at the other end with a vertical extension, the upper end of which is further extended horizontally into a support block 3. The presser arm support member 1 is movable in the counterclockwise direction by the manual operation of a worker, although the details thereof are not shown. The shaft 2 of the support member 1 is rotatably and loosely provided in the center of a rocking block 4, which is connected at the upper end to a link 5 which is a longitudinal driving member in the cloth feed mechanism of the sewing machine and which reciprocates horizontally interlocked with a horizontal feed shaft (not shown) for the control of horizontal feed and which rotatably supports at the lower end a horizontal stub shaft 8 perpendicular to the cloth feed direction. The horizontal shaft 8 is integrally formed with a connection block 7 having a horizontal forked end 6. The upper feed dog 10 is located at one end of the upper feed arm 9 whereas a flat portion 11 at its other end loosely engages the forked end 6 of the connection block 7 so that the upper feed arm 9 is rotatable in the clockwise direction around a vertical pin 12 as a vertical axis in FIG. 1. A presser shaft 13 for pressing the upper feed arm 9 loosely engages by a recess 14, at the lower end, both sides of the upper feed arm 9 and has a roller 15 provided in the portion opposing the upper surface of the upper feed arm 9. The presser shaft 13 is vertically movable through an adjustment screw 16 threaded into the machine frame of the sewing machine and is always biased downwardly by the resiliency of a spring 17 mounted within the adjustment screw 16. A knife arm 18 that supports a cloth cutting knife (not shown) at the top end is adapted to be rocked by its shaft 19 interlocked with the mechanism of the sewing machine such that it rotates clockwise while a needle (not shown) is being inserted into the cloth. A vertically movable arm 20, as the vertical driving member, is integrally formed with the knife arm 18 and extended rearwardly. A roller 21 supported at the top end of the arm 20 opposes the lower face on the top end of a leaf spring 22, whose base end is secured to the lower surface of the upper feed arm 9, and causes the upper feed arm 9 to rotate in the counterclockwise direction around the horizontal shaft 8 on the connection block 7 against the resilliency of the spring 17 when the knife arm 18 rotates in the clockwise direction.

In this embodiment having the foregoing construction, when the sewing machine is driven with the upper feed dog 10 being at a position opposing the sewing area as shown in FIG. 1, the upper feed dog 10 moves in four directions with an opposite phase in its vertical movement to that of the vertical movement of the main sub feed dogs situated below a throat plate (not shown).

Specifically, at a time when a needle leaves the cloth moving upwardly, the link 5 moves rightwardly to rotate the rocking block 4 clockwise relative to the outer circumference of the shaft 2. The rocking movement causes the upper feed arm 9 to move leftwardly by way of the horizontal shaft 8, the connection block 7 and the pin 12, whereby the upper feed dog 10 moves in the cloth feed direction (indicated by the arrow in FIG. 1) while pressing the upper surface of the cloth by the resiliency of the spring 17 to feed the cloth. The horizontal shaft 8 of the connection block 7 rotates slightly relative to the lower end of the rocking block 4 in this case.

Then at a time when the needle descends to penitrate the cloth, the knife arm 18 rotates clockwise around the shaft 19 to move the roller 21 upwardly to thus raise the lower surface of the upper feed arm 9 by way of the leaf spring 22 against the resiliency of the spring 17, whereby the upper feed arm 9 rotates counterclockwise around the horizontal shaft 8 of the connected block 7 and the upper feed dog 10 rises from the upper surface of the cloth.

Subsequently, when the link 5 moves leftwardly, the rocking block 4, the connection block 7 and the upper feed arm 9 are rocked or moved in directions opposite to those in the cloth feed state respectively, whereby the upper feed dog 10 returns rightwardly in FIG. 1 while being moved upwardly from the upper surface of the cloth.

Then, at a time when the needle rises to leave the cloth, the knife arm 18 rotates counterclockwise around the shaft 19 to lower the roller 21 and the upper feed arm 9 rotates clockwise around the horizontal shaft 8 of the connection block 7 under the resiliency of the spring 17 to lower the upper feed dog 10 so as to pressingly contact the upper surface of the cloth by the resiliency of the spring 17, whereby the initial state is resumed.

By repeating the above movements in the vertical and the longitudinal, i.e. horizontal directions, the upper feed dog 10 conducts the four directional movement on or above the cloth for feeding it.

If it is required to exchange the needle or to thread the needle, the presser shaft 13 is raised either by loosening the adjust screw 16 or against the resiliency of the spring 17 to elevate the recess 14 at the lower end from above the upper end of the upper feed arm 9. Thereafter, the right hand portion of the upper feed arm 9 is pulled to this side in the drawing. Then, the upper feed arm 9 rotates in the clockwise direction around the pin 12 to move the upper feed dog 10 sideways away from the sewing area of the machine, wherein needle exchange or threading is conducted.

Figure 2:
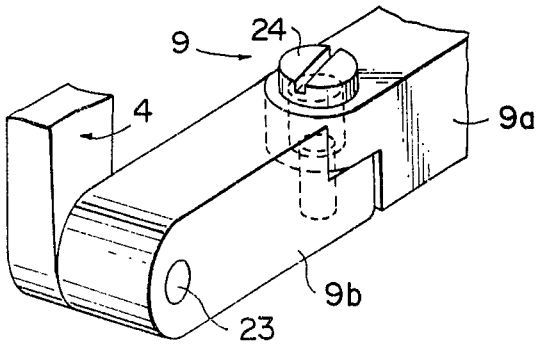
FIG. 2 is a perspective view for a part of the upper feed dog arm used in a second embodiment of this invention.

FIG. 2 shows a part of the second embodiment of this invention, wherein the upper feed arm 9 is bisected into a fore arm portion **9*a* and a rear arm portion 9*b*. The rear arm portion 9*b* is connected at one end to the lower end of the rocking block 4 by means of a horizontal connecting shaft 23 perpendicular to the cloth feed direction; and the rear arm portion 9*b* and the fore arm portion 9*a* are rotatably connected to each other by means of a stepped screw as a vertical axis whose axial line is in a vertical direction so that the fore arm portion 9*a* is rotatable clockwise around the stepped screw 24**.

In the second embodiment having this construction, the upper feed dog (not shown) supported at the leading end of the fore arm portion **9*a***, can also move in the four directions for feeding the cloth, as well as move sideways away from the sewing area for exchanging the needle or threading the needle in the same manner as in the first embodiment.

Figure 3:
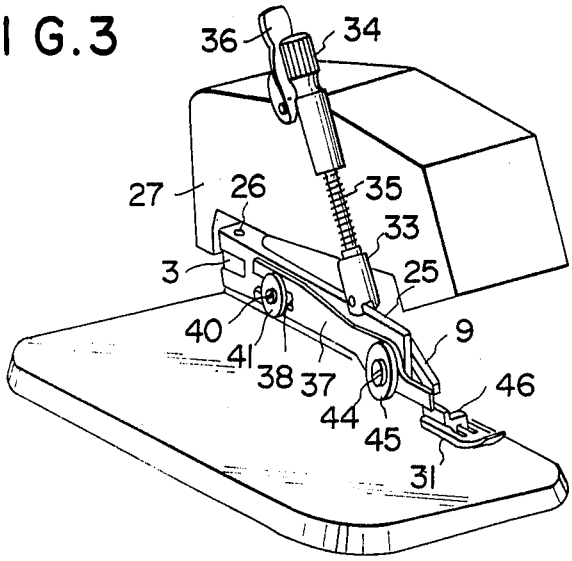
Figure 4:
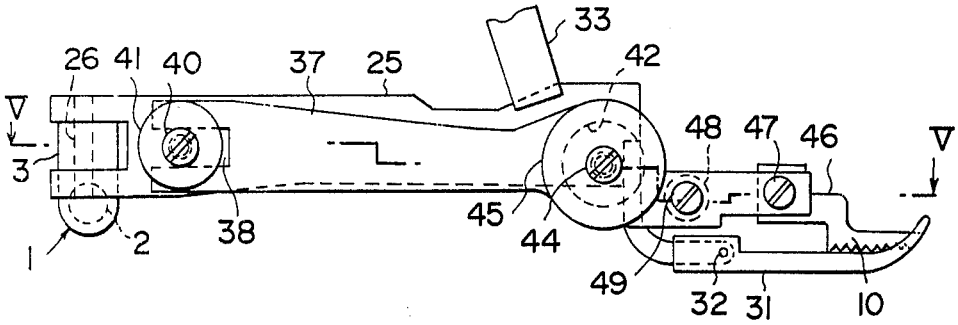
Figure 5:
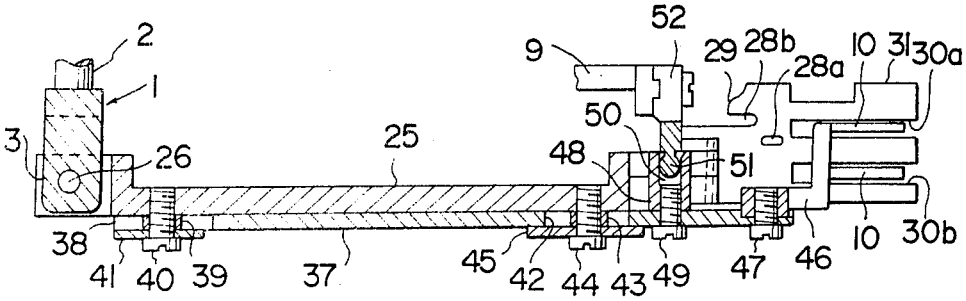

FIGS. 3, 4 and 5 show the third embodiment of this invention, wherein a presser arm 25 is rotatably connected at its rear base end to the support block 3 of the presser arm support member 1 shown in FIG. 1 by means of a vertical pin 26 as a vertical axis. The presser arm support member 1 is rotatably supported by the integrally formed and horizontally extending shaft 2 to a machine frame 27, as stated above, and is manually rotatable by the worker in the counterclockwise direction in FIG. 4, while details thereof are not shown. The presser arm 25 supports at its top end, by means of a pin 32 having a horizontal axial line perpendicular to the cloth feed direction, a cloth presser foot 31 on which are formed needle passing apertures **28*a* and 28*b*, a thread guarding finger 29 and upper feed dog grooves 30*a* and 30*b* that open upstream of the needle passing aperture in the cloth feed direction. Presser member 33 contacts at the lower forked end the upper end of the presser arm 25, supported at the upper end vertically movably to the machine frame 27 and normally urges the leading end of the presser arm 25 downwardly by the resiliency of a compression spring 35 mounted between the lower end face of an adjust screw 34 threaded into the machine screw 27 and the presser member 33. A pressure release lever 36, details of which are well-known and not shown, is provided for manipulating the lower end of the presser member 33 between a pressing position in contact with the presser arm 25 and a non-pressing position elevated upwardly apart from the presser arm 25. An upper feed member 37, as a support member, is loosely engaged at the rear forked end 38 to the side of the presser arm 25 while putting a collar 39 between a rear washer 41 fixed by a screw 40 and the side face of the presser arm 25. The upper feed member 37 is formed at the front end with an idle hole 42 and supported by this portion to the side of the presser arm 25 movably both in the longitudinal direction (backward-to-forward direction) and vertical direction by means of a front washer 45 of a larger diameter fixed by a screw 44 by way of a collar 43 of a smaller diameter in the idle hole 42. An upper feed dog member 46 is fixed to the front end of the upper feed member 37 by a screw 47 so that its pair of feed dogs 10 correspond to the upper feed dog grooves 30*a* and 30*b* in the cloth presser foot 31 respectively. A cylinder 48, as one component of the connecting mechanism, is fixed at its base end to one end face of the upper feed member 37 by a screw 49 and formed at its leading end with an engaging aperture 50 which is perpendicular to the cloth feed direction and opens horizontally. Reference numeral 9 represents the leading end of the upper feed arm which is similar to that shown in FIG. 1 but not necessarily supported rotatably sideways, e.g., around the pin 12 in this case. The leading end of the upper feed arm 9 is normally projected under the downward resiliency near the sewing area and, interlocked with the mechanism of the sewing machine, moves in four directions with an opposite phase in the vertical movement to that of the vertical movement of the main and sub feed dogs. The leading end has an engaging block 52 formed with a spherical portion 51 as the other component of the connection mechanism that opposes to and engages the engaging aperture 50 in the cylinder 48**.

In the third embodiment, the engaging aperture 50 in the cylinder 48 as one component of the connection mechanism fixed to the upper feed member 37 and the spherical portion 51 of the engaging block 51 as the other component of the connection mechanism fixed to the upper feed arm 9 engage with each other in the state shown in FIGS. 3, 4 and 5.

When the sewing machine is driven in the state described above, the needle moves vertically and the main and sub feed dogs opposing the cloth presser foot 31 also move in four directions to feed the cloth in cooperation with the presser foot in a well-known manner, while not shown. While on the other hand, the upper feed arm 9 is interlocked with the mechanism of the sewing machine and the spherical portion 51 at the loading end also moves in four directions with the opposite phase in the vertical movement to that of the vertical movement of the main and sub feed dogs; that is, when the main and sub feed dogs rise the spherical portion 51 descends and, thereafter, moves in the cloth feed direction and, when the main and sub feed dogs descend, it rises and then moves in the direction opposite to the cloth feed direction. The four directional movement of the spherical portion 51 is transmitted by way of the engaging aperture 50 in the cylinder 48 to the upper feed member 37. Thus, as shown in FIG. 4, when the spherical portion 51 descends, the upper feed member 37 rotates clockwise at its rear fork end 38 around the collar 39 to press the cloth onto the upper surface of the throat plate by the lower end of the upper feed dog 10 at the leading end. Then, when the spherical portion 51 moves in the cloth feed direction, the forked end of the upper feed member 37 slides at the collar 39 to feed the cloth by the upper feed dog 10. Subsequently, when the spherical portion 51 moves in the direction opposite to the cloth feed direction, the forked end slides at the collar 39 to return the upper feed dog 10 to is beginning position. The upper feed dog 10 thus moves in four directions for feeding the cloth.

In order to exchange the needle, thread the needle or the like, the needle is moved to an elevated position and the pressure release lever 36 is manipulated to move the presser member 33 upwardly from the presser arm 25. Thereafter, when the leading end of the presser arm 25 or the upper feed member 37 is pushed sideways (or downwardly in FIG. 5), engagement between the spherical portion 51 and the engaging aperture 50 is released, whereby the presser arm 25 rotates around the pin 26 at the rear end and the upper feed member 37 having the upper feed dog 10 also rotates simultaneously with the presser arm 25 to move the cloth presser foot 31 and the upper feed dog 10 to positions separated from the sewing area. The work of exchanging the needle can be conducted with ease in this state.

After the completion of the work, the presser arm 25 or the upper feed member 37 is rotated around the pin 26 in the direction opposed to that described above, the engaging aperture 50 in the cylinder 48 and the spherical portion 51 are aligned and engaged with each other and the pressure release lever 36 is manipulated to lower the presser member 33 to the upper surface of the presser arm 25, whereby the presser foot 31 and the upper feed dog 10 return to their beginning positions thereby enabling the cloth to be fed by the upper feed dog 10.

In the state shown in FIGS. 3 and 4 where the presser foot 31 and the upper feed dog are positioned in the sewing area, when the worker manually rotates the presser arm support member 1 counterclockwise around the shaft 2 in FIG. 4, the presser arm 25 at first rises against the resiliency of the spring 35 and the presser foot 31 begins to rise. When the presser arm 25 is further elevated after the portion of the presser plate 25 that supports the presser foot 31 has contacted to the lower surface of the cylinder 48, the cylinder 48 moves upwardly, whereby the upper feed arm 9 rises by way of the engaging block 52 against the downward resiliency and the leading end of the upper feed member 37 is also raised to move the upper feed dog 10 upwardly from the upper surface of the upper feed dog 10. Thereafter, when the operation to the presser arm support member 1 is released, the presser arm 25 and the upper feed member 37 are returned to the lowered home positions respectively by their resiliency.

Figure 6:
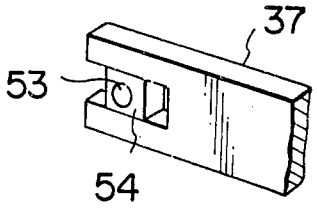
FIG. 6 is a perspective view for a part of the upper feed member in a fourth embodiment of the invention.
Figure 7:
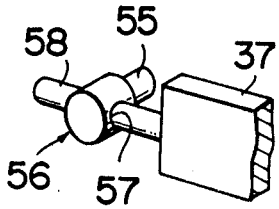
FIG. 7 is a perspective view for a part of the upper feed arm member in a fifth embodiment of this invention.
Figure 8:
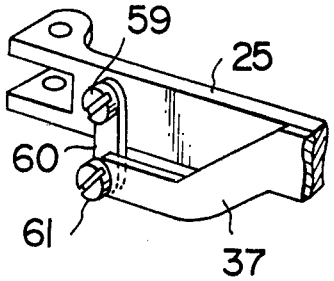
FIG. 8 is a perspective view for a part of the upper feed member in a sixth embodiment of this invention.

Although the rear forked end of the upper feed member 37 is made slidable along the cloth feed direction, as well as rotatable around the horizontal axis perpendicular to the cloth feed direction relative to the outer circumference of the collar 39 in the third embodiment, the four directional movement of the upper feed dog 10 at the leading end of the upper feed member 37 is also possible in various other modifications. FIG. 6 shows the fourth embodiment, wherein the forked end of the upper feed member 37 is made slidable to a square die 54 rotatably supported to a shaft 53 provided on the end face of the presser arm 25. FIG. 7 shows the fifth embodiment, wherein a shaft 58 provided to the rear end of the upper feed member 37 is connected slidably in the forward to backward direction to a pivotal member 56 whose shaft 55 is rotatable to the end face of the presser arm 25. FIG. 8 shows the sixth embodiment, wherein the upper or lower tip of the forked end is rotatably connected by way of a stepped screw 61 to one end of a vertical link 60 which is rotatably supported at the other end to the presser arm 25 by way of a stepped screw 50.

Further, although the upper feed dog 10 is shown as situated at the upstream of the needle passing apertures in the cloth feed direction in each of the embodiments, the upper feed dog may, of course, be disposed at the downstream of the needle passing apertures in the cloth feed direction.

Furthermore, although the spherical portion 51 and the engaging aperture 50 in the cylinder 48 are employed as the connection mechanism between the leading end of the upper feed member 37 and the upper feed arm 9 in each of the foregoing embodiments, similar effects can be obtained by forming engaging apertures both in the upper feed member 37 and the leading end of the upper feed arm 9 and detachably mounting an engaging shaft to these engaging apertures.

As previously stated the upper feed arm 9 or the upper feed member 37, as the support member for supporting the cloth feed dog 10 is adapted to move in four directions on or above the upper surface of the cloth with a phase in the vertical movement opposite to that of the vertical movement of the lower feed dogs situated below the throat plate. It is designed to normally transmit the four directional movement to the upper feed dog 10 for feeding the cloth, as well as being made rotationally displaceable around a vertical axis in the direction for separating the upper feed dog sideways from the sewing area. The support member normally functions as the upper feed dog mechanism to the cloth and also improves operator efficiency by facilitating exchanging the needle, threading the needle or removing thread entangled in the sewing area and the looper due to thread disconnection.

It should be apparent to one skilled in the art of the above that the described embodiments are merely illustrative of but a few of the many possible specific embodiments of the present invention. Numerous and varied other arrangements can be readily deviced by those skilled in the art without departing from the spirit and scope of the invention.

What is claimed is:

1. A cloth feed mechanism for sewing machines comprising a lower feed dog which moves in and out as well as moves longitudinally to a throat plate and a support member having an upper feed dog fixed thereon adapted to move, interlocked with a driving member, in four directions above an upper surface of the throat plate with a phase in the vertical movement being opposite to that in the vertical movement of the lower feed dog and with a phase in the longitudinal movement being identical to that in the longitudinal movement of the lower feed dog for feeding the cloth in synchronism with the the lower feed dog, wherein said support member is rotatably supported around a vertical shaft so that the upper feed dog can be moved sideways from a position opposite to the sewing area, and further, a base portion of said support member is supported in a manner to be rotatable about a horizontal axis perpendicularly intersecting a direction of feeding cloth so that said upper feed dog can move in four directions.

2. The cloth feed mechanism for sewing machine of claim 1, wherein said driving member comprises a longitudinal driving member and a vertical driving member, whereby said upper feed dog repeates the movements in four directions consisting of movement in the cloth feed direction, movement in the upward direction, movement in the direction opposite to the cloth feed direction and movement in the downward direction.

3. The cloth feed mechanism for sewing machine of claim 2, wherein said support member is constituted as an upper feed arm, which is provided at the leading end thereof with an upper feed dog, connected at the rear end thereof to the longitudinal driving member and made rotatable in a sideways direction around a vertical axis, contacted at the middle of the lower surface thereof to the vertical driving member and applied with downward resiliency from above by a spring.

4. The cloth feed mechanism for sewing machine of claim 2, wherein said support member is constituted as an upper feed member having an upper feed dog at the leading end thereof, said upper feed member is supported movably both longitudinally and vertically to a presser arm having at the leading end thereof a presser foot formed with upper feed dog grooves through which the upper feed dog engages and disengages with the cloth and it is made to rotate in a sideways direction at the rear end thereof around a vertical axis, said upper feed member is detachably connected to an upper feed arm which is connected at the rear end thereof to the longitudinal driving member, contacted at the middle of a lower surface thereof to the vertical driving member and applied with downward resiliency from above by a spring.

* * * * *